United States Patent [19]

Delmerico et al.

[11] Patent Number: 5,071,024

[45] Date of Patent: Dec. 10, 1991

[54] COVER LATCH FOR A CONTAINER

[75] Inventors: Paul E. Delmerico; Howard W. Andrews, Jr., both of Winchester, Va.

[73] Assignee: Rubbermaid Commercial Products Inc., Winchester, Va.

[21] Appl. No.: 572,474

[22] Filed: Aug. 23, 1990

[51] Int. Cl.[5] ..... B65D 43/24

[52] U.S. Cl. ..... 220/335; 220/337; 220/908

[58] Field of Search ..... 220/335, 337, 342, 343, 220/908

[56] References Cited

U.S. PATENT DOCUMENTS

| | | | |
|---|---|---|---|
| 3,136,575 | 6/1964 | Kolling | 220/908 X |
| 3,272,379 | 9/1966 | Driza et al. | 220/335 |
| 4,193,164 | 3/1980 | Okayama | 220/335 X |
| 4,349,120 | 9/1982 | DiNardo | 220/337 |
| 4,354,543 | 10/1982 | Bogner | 220/335 X |
| 4,655,365 | 4/1987 | Miller | 220/314 |
| 4,749,101 | 6/1988 | Durkan, Jr. | 220/337 |
| 4,789,078 | 12/1988 | Miller et al. | 220/335 |
| 4,836,394 | 6/1989 | Glomski | 220/335 X |
| 4,914,781 | 4/1990 | Sokn et al. | 220/335 X |
| 4,972,966 | 11/1990 | Craft, Jr. | 220/264 |

*Primary Examiner*—Stephen Marcus
*Assistant Examiner*—Vanessa Caretto
*Attorney, Agent, or Firm*—Renner, Kenner, Greive, Bobak, Taylor & Weber

[57] ABSTRACT

A container (10) includes a base portion (11) having a cover (12) attached thereto by a hinge assembly (13). Plates (25, 26) extend outwardly from the base portion (11) and together with arms (27, 28) extending outwardly from the cover (12) carry a latch mechanism (34) to maintain the cover (12) in an open position. The latch mechanism (34) includes complementary lock barbs (35, 38) on a plate (26) and an arm (28), each lock barb (35, 38) having a camming surface (36, 39) and a lock surface (37, 40). As the cover (12) is rotated, the camming surface (39) of the lock barb (38) rides over the camming surface (36) of the lock barb (35) until the lock surfaces (37, 40) engage each other.

23 Claims, 5 Drawing Sheets

COVER LATCH FOR A CONTAINER

TECHNICAL FIELD

This invention relates to a device which latches or locks a cover for a container in an open position. More specifically, this invention relates to such a device as used for a cover which is hinged to the base portion of a container, and has particular application to large refuse containers having wheels for the facile transporting of the same.

BACKGROUND ART

Many containers of all types are provided with covers that are hinged to the base portion of the containers so that the containers may be readily opened and closed. While some containers are provided with a means to maintain the cover latched to the container base when in a closed position, few, if any, provide a means to maintain the cover in an open position and out of the way of the user.

The need to maintain container covers in an open position is particularly prevalent in large containers, such as refuse containers, and especially in those which are provided with wheels for the facile transporting of the containers. In these instances the container cover is usually hinged to the body at the top thereof on the same side that the wheels are positioned near the bottom thereof. The user then can transport the container by tilting it so that all of its weight is on the wheels. However, in so doing, if the cover is swung open from the container base and is not affixed thereto in the open position, the cover can flop or swing away from the container, undesirably striking the legs of the user as he transports the container. This can only be avoided by always transporting the container in a closed position, which is not always desirable to the user, or by providing some means to hold the cover in an open position.

However, heretofore, no such containers have been provided with any convenient way of maintaining the cover in the open position short of the user employing tape, rope or some other inconveniently applied temporary locking mechanism.

DISCLOSURE OF THE INVENTION

It is thus the primary object of the present invention to provide a container, having a cover hinged thereto, with a device which latches or otherwise locks the cover in an open position.

It is another object of the present invention to provide a device, as above, which is simple for the user to employ, and one in which no extra effort on the part of the user is necessary.

It is a further object of the present invention to provide a device, as above, which does not add to the manufacturing or assembly cost of the container having the device.

These and other objects of the present invention, as well as the advantages thereof over existing prior art forms, which will become apparent from the description to follow, are accomplished by the means hereinafter described and claimed.

In general, the container according to the present invention includes a base portion having an open top and a cover hingedly attached to the base portion so that it can be swung from a position closing the top of the base portion to an open position. Complementary means are provided on the base portion and on the cover to temporarily latch the cover to the base portion as the cover is being swung on the hinges to the open position.

A preferred exemplary refuse container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
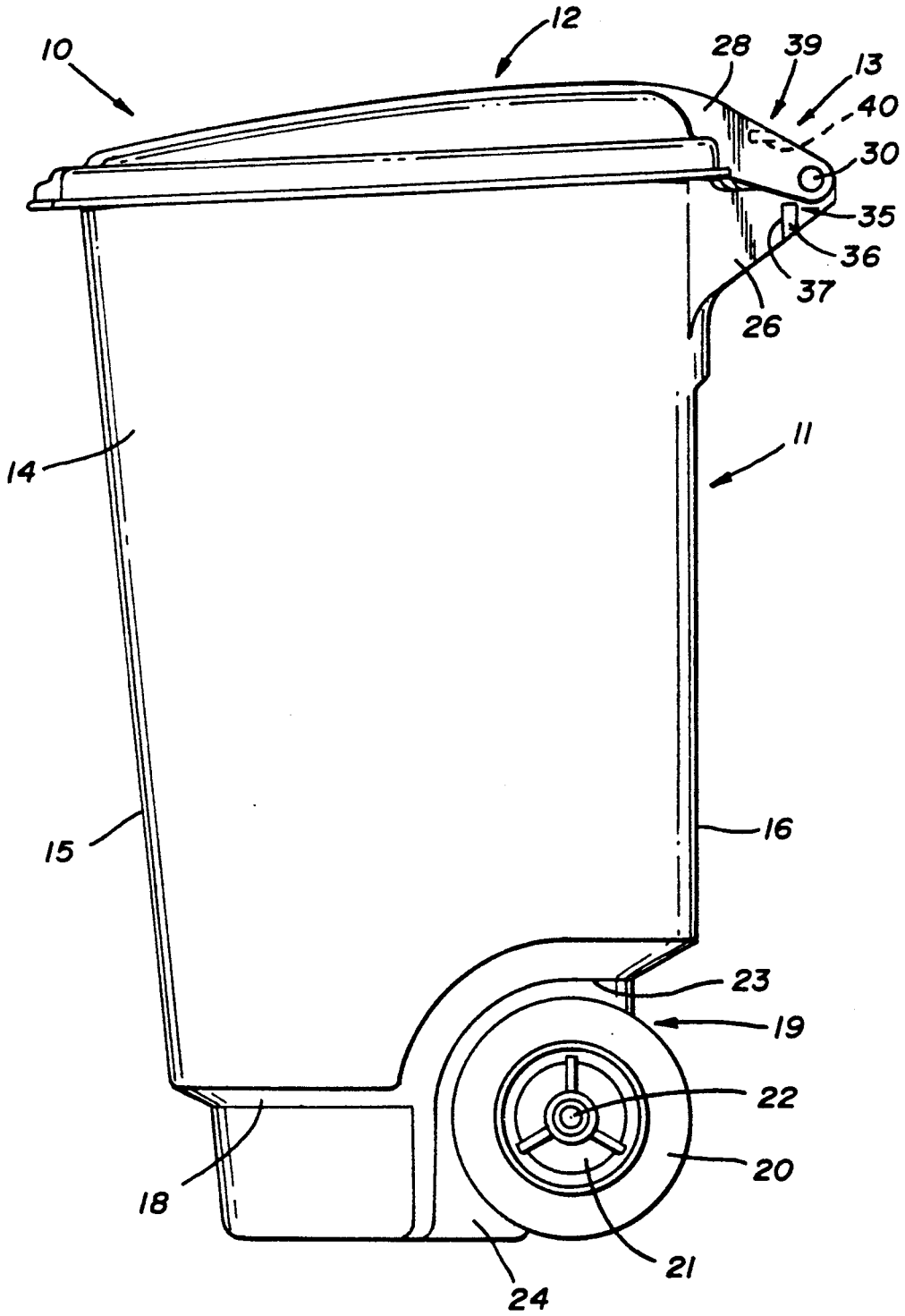
FIG. 1 is a side elevational view of a refuse container having a cover latching device according to the concept of the present invention.
Figure 2:
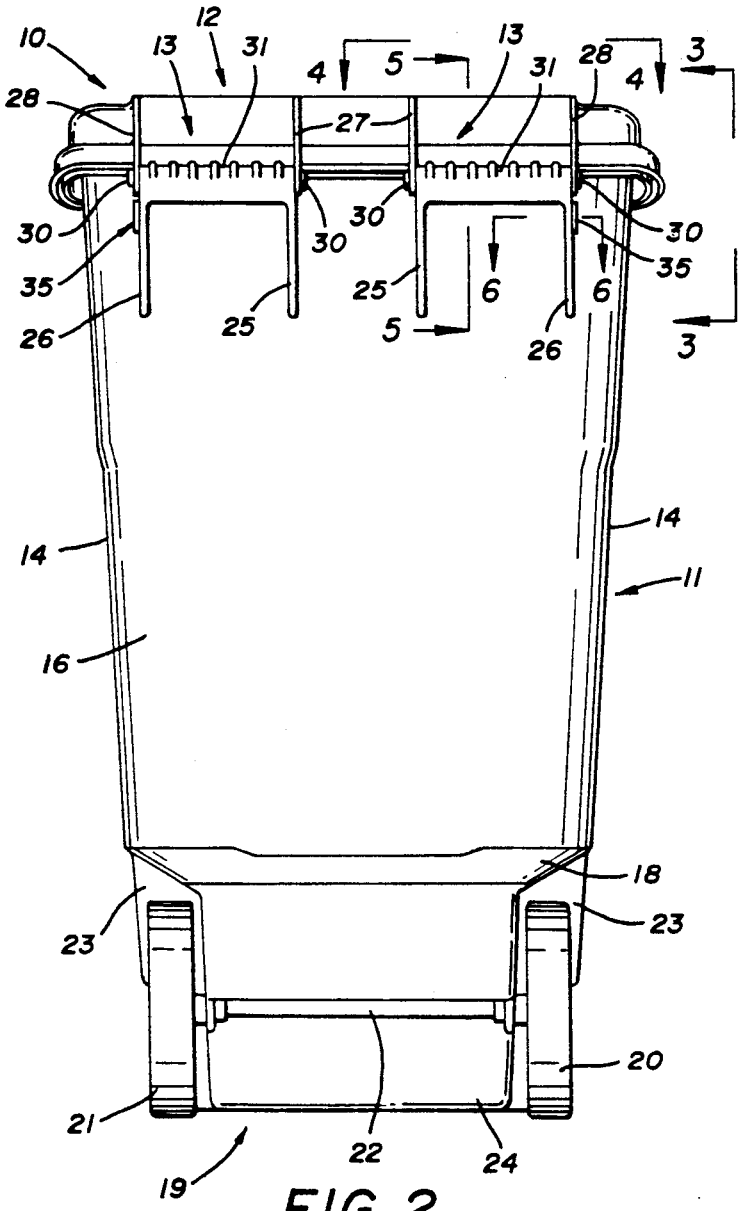
FIG. 2 is a rear elevational view of the refuse container shown in FIG. 1.
Figure 3:
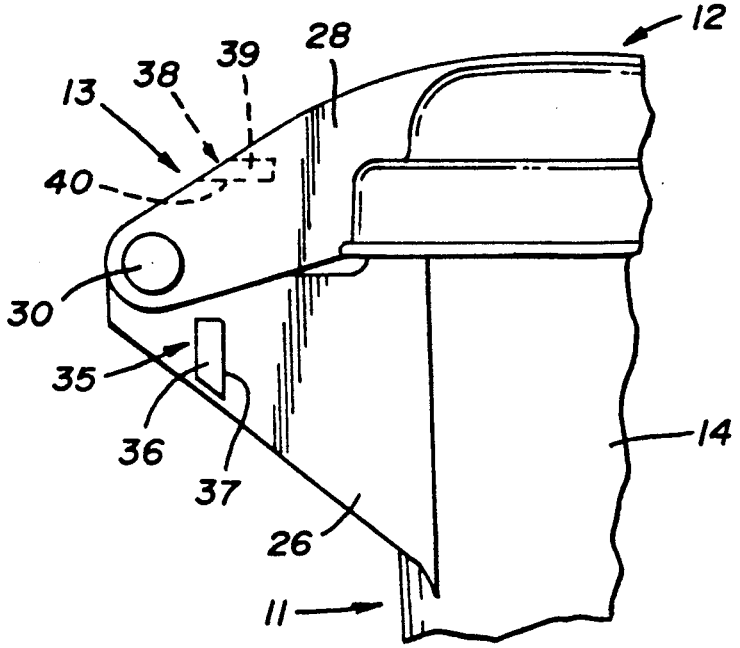
FIG. 3 is an enlarged fragmented elevational view taken substantially along line 3—3 of FIG. 2.
Figure 4:
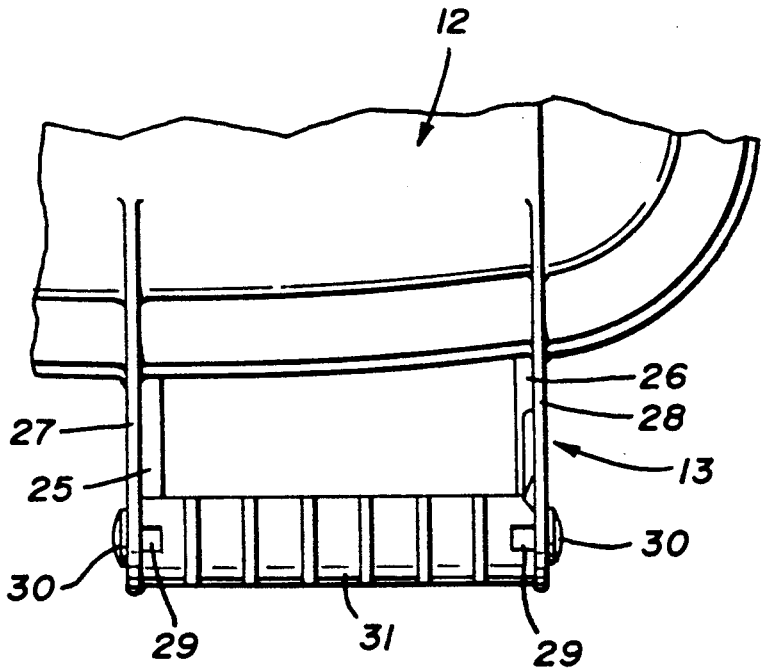
FIG. 4 is an enlarged fragmented plan view taken substantially along line 4—4 of FIG. 2.

A container embodying the concept of the present invention is indicated generally by the numeral 10 in the drawings and is shown in the form of a refuse container having a base portion indicated generally by the numeral 11 and a cover portion indicated generally by the numeral 12. Cover 12 is shown as being attached to base portion 11 by a hinge, handle and latch assemblies generally indicated by the numeral 13. Base portion 11, cover 12 and assembly 13 are preferably conveniently molded of any suitable plastic material, such as high density polyethylene, but base portion 11 and cover 12 could be made of any other material, such as metal, without departing from the subject invention.

While the exact configuration of base portion 11 is not at all critical to this invention, it is shown as being generally rectangular in shape having generally vertically oriented sidewalls 14, a front wall 15 and a rear wall 16, together defining a container having an open top, as at 17 (FIG. 5), and a closed bottom 18. It is to be understood, however, that base portion 11 could take on other configurations, such as cylindrical, without departing from the spirit of this invention. Container 10 is also shown as including a wheel assembly, indicated generally by the numeral 19, positioned generally near the bottom of rear wall 16 of base portion 11. As will hereinafter become evident, the presence of wheel assembly 19 is likewise not critical to the present invention; however, the present invention does have particular usefulness with containers that do have such a wheel assembly.

Wheel assembly 19 includes the two wheels 20 themselves, preferably made of a rubber material, mounted on plastic hubs 21 and carried by an axle 22. Wheels 20 are protectively received within wheel wells 23 extending from the bottom of rear wall 16 and forming a portion of container bottom 18. A bearing block 24 which depends from bottom 18 between wheel wells 23 receives axle 22 therethrough for rotation therein.

As best shown in FIGS. 3–6, inclusive, each hinge, latch and handle assembly 13 includes a pair of inner and outer gusset plates, 25 and 26, respectively, extending outwardly from near the top of rear wall 16 of base portion 11. Each assembly 13 also includes a pair of inner and outer arms, 27 and 28, respectively, extending outwardly from the rear of cover 12. The upper ends of gusset plates 25 and 26 and the lower ends of arms 27 and 28 are provided with corresponding apertures which are aligned and receive the shafts 29 of pivot pins 30 therethrough. A handle grip 31 is provided for each assembly 13 and is provided with a hole on each axial end thereof to receive, in a snap fit fashion, shafts 29 of pins 30.

Figure 5:
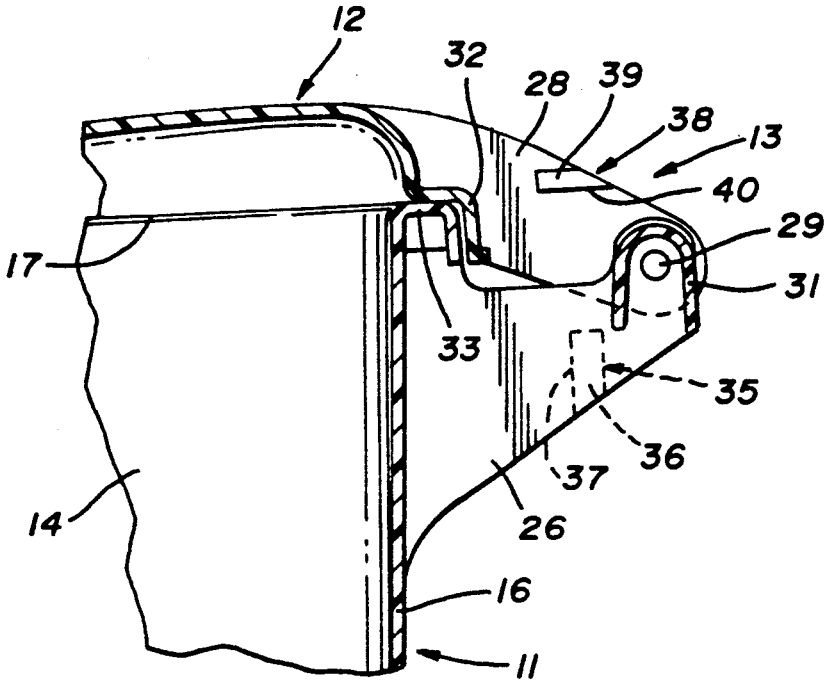
FIG. 5 is an enlarged fragmented sectional view taken substantially along line 5—5 of FIG. 2.
Figure 7:
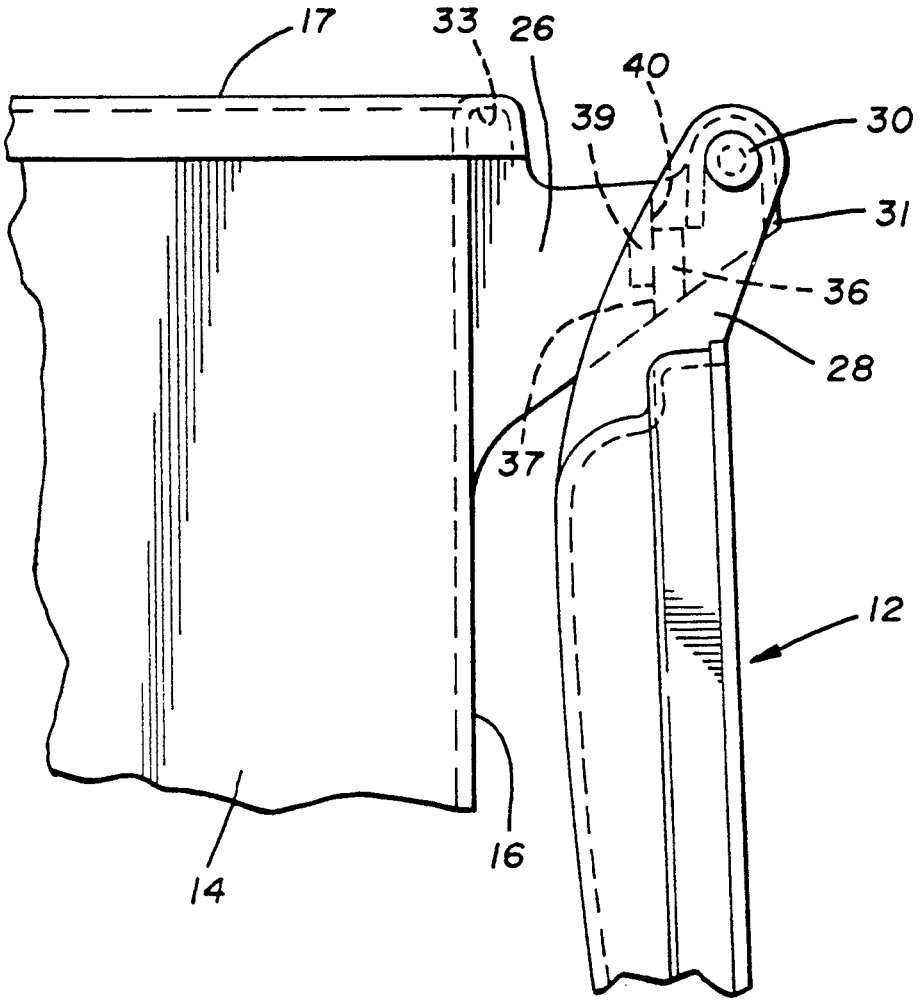
FIG. 7 is an enlarged fragmented elevational view showing the cover in an open and latched position.

Such containers, just described, allow cover 12 to be hinged to base portion 11. By a clockwise (as seen in FIG. 5) rotation of cover 12, and thus arms 27 and 28 about pins 30, a downturned lip 32 on cover 12 disengages an upper rim 33 on base portion 11 and cover 12 can thus be rotated approximately 270° to a position approximately parallel with rear wall 16 of base portion 11 as shown in FIG. 7. Container 10 may also be readily transported by the user merely by grasping handles 31. By applying a downward and slightly outward force on handles 31, container 10 will tilt, placing all of its weight on wheels 20, for the facile moving thereof.

When cover 12 is in the fully open position, that is, generally vertically oriented and approximately parallel to rear wall 16, unless somehow latched in place, as by the latch portion of assembly 13, now to be described, cover 12 would be free to swing about pivot pin 30 thereby banging against rear wall 16 or any obstruction outwardly of rear wall 16. Such becomes a particular annoyance when the user is transporting the open container, as previously described, because the obstruction becomes the lower extremities of the user himself.

Thus, assembly 13 includes a means by which cover 12 may be immobilized or otherwise restrained from rotation when in the fully open position. To this end each assembly 13 is provided with a latch mechanism, generally indicated by the numeral 34 in FIG. 6, to temporarily affix each arm 28 of cover 12 to each gusset plate 26. Latch mechanism 34 includes a locking barb, generally indicated by the numeral 35, molded into the outside surface of each outer gusset plate 26, that is, the surface facing away from inner gusset plate 25. Each locking barb 35 includes a camming surface 36 extending outwardly from the rear of plate 26 and terminating as a vertically oriented lock surface 37 extending angularly inwardly back to the main body of gusset plate 26.

Latch mechanism 34 also includes a locking barb, generally indicated by the numeral 38, molded into the inside surface of each outer arm 28 of cover 12, that is, the surface facing inner arm 27, as well as facing the outside surface of outer gusset plate 26. Each locking barb 38 includes a camming surface 39 extending downwardly (when cover 12 is in the closed position shown, for example, in FIG. 5) and outwardly from near the top surface of arm 28 and terminating as a horizontally oriented (as seen in FIG. 5) lock surface 40 extending angularly inwardly back to the main body of arm 28.

Figure 6:
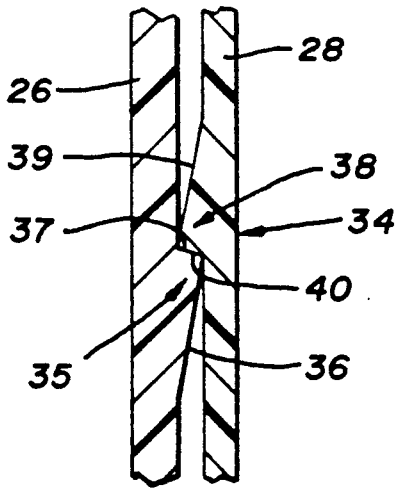
FIG. 6 is an enlarged fragmented sectional view taken substantially along line 6—6 of FIG. 2, but with the cover in an open and latched position.

Locking barbs 35 and 38 are positioned so as to interfere with each other as cover 12 is being opened. As cover 12 begins to reach the generally vertical, open position, having been swung approximately 270° from the closed position, camming surfaces 39 on the moving arms 28 slide along the complementary camming surfaces 36 on the stationary gusset plates 26, this movement being upward as the parts appear in FIG. 6. The resiliency of the plastic arms 28 and gusset plates 26 permits such movement whereby arms 28 and plates 26 are temporarily spread apart from each other until the outermost termination of camming surfaces 39 and 36 are aligned, at which point further movement of cover 12 snaps lock surfaces 37 and 40 into abutting engagement, as shown in FIGS. 6 and 7. Such locking engagement is sufficient to hold cover 12 in place against the influence of gravity, for example, if container 10 were tilted onto wheels 20 for the transportation thereof. Because lock surfaces 37 and 40 are complementarily angled, however, pulling cover 12 outwardly away from body portion 11 (rotating cover 12 counterclockwise, as seen in FIG. 5, from the open to closed position, that movement being downward as seen in FIG. 6) overcomes the latching engagement of barbs 35 and 38 and thus permits cover 12 to be manually closed on base portion 11.

It should thus be evident that a container having a cover latch assembly constructed according to the concepts of the present invention provides a simple, yet effective, manner in which to maintain the cover of the container in a fully open position thus substantially improving the art and otherwise accomplishing the objects of the present invention.

We claim:

1. A container comprising a base portion having generally vertical walls and an open top, a cover to close the open top of said base portion, hinge means connecting said cover to said base portion so that said cover may be swung from a position closing the top of said base portion to an open position generally parallel and adjacent to a said wall of said base portion, and complementary means carried by said base portion and carried by said cover to temporarily latch said cover to said base portion after said cover has been swung approximately 270 degrees to the open position to maintain said cover generally parallel and adjacent to said a said wall of said base portion.

2. A container according to claim 1 further comprising plate means extending outwardly from said base portion and carrying a portion of said complementary means, and arm means extending outwardly from said cover and carrying a portion of said complementary means.

3. A container according to claim 2 wherein said plate means and said arm means having outer ends and said hinge means includes pin means attaching said outer end of said plate means to said outer end of said arm means so that said arm means can rotate on said pin means with respect to said plate means.

4. A container according to claim 2 wherein said complementary means includes first lock barb means on said plate means and second lock barb means on said arm means, said first and second lock barb means engaging each other to temporarily latch said cover to said base portion.

5. A container according to claim 4 wherein said first and second barb means each include a camming surface, said camming surface of said second barb means riding over said camming surface of said first barb means as said cover is being swung to the open position.

6. A container according to claim 5 wherein said first and second barb means each includes a lock surface at the end of said camming surface, said lock surfaces engaging each other when said cover is in the fully open position.

7. A container according to claim 6 wherein said plate means and said arm means have outer ends and said hinge means includes pin means attaching said outer end of said plate means to said outer end of said arm means so that said arm means can rotate on said pin means with respect to said plate means.

8. A container according to claim 1 wherein said hinge means connects said cover to said base portion near the top of said base portion on said a said wall thereof, and further comprising wheels mounted near the bottom of said base portion on said a said wall thereof.

9. A container according to claim 8 further comprising plate means extending outwardly from said base portion on said a said wall thereof and arm means extending outwardly from said cover adjacent to said plate means.

10. A container according to claim 9 wherein said plate means and said arm means have outer ends and said hinge means includes pin means attaching said outer end of said plate means to said outer end of said arm means so that said arm means can rotate on said pin means with respect to said plate means.

11. A container comprising a base portion having an open top, a cover to close the open top of said base portion, hinge means connecting said cover to said base portion so that said cover may be swung from a position closing the top of said base portion to an open position, complementary means carried by said base portion and carried by said cover to temporarily latch said cover to said base portion after said cover has been swung to the open position, first plate means extending outwardly from said base portion and carrying a portion of said complementary means, first arm means extending outwardly from said cover and carrying a portion of said complementary means, second plate means extending outwardly from said base portion and spaced from said first plate means, second arm means extending outwardly from said cover and spaced from said first arm means, and handle means in the space between said first plate means and said first arm means and said second plate means and said second arm means.

12. A container comprising a base portion having an open top, a cover to close the open top of said base portion, hinge means connecting said cover to said base portion so that said cover may be swung from a position closing the top of said base portion to an open position, complementary means carried by said base portion and carried by said cover to temporarily latch said cover to said base portion after said cover has been swung to the open position, first plate means extending outwardly from said base portion, first arm means extending outwardly from said cover, said first plate means and said first arm means having outer ends, second plate means extending outwardly from said base portion and spaced from said first plate means, second arm means extending outwardly from said cover and spaced from said first arm means, and handle means in the space between said first plate means and said first arm means and said second plate means and said second arm means, said hinge means including pin means attaching said outer end of said first plate means to said outer end of said first arm means so that said first arm means can rotate on said pin means with respect to said first plate means, said complementary means including first lick barb means on said first plate means and second lock barb means on said first arm means, said first and second barb means each including a camming surface and a lock surface at the end of each said camming surface, said camming surface of said second barb means riding over said camming surface of said first barb means as said cover is being swung to the open position, and said lock surfaces engaging each other when said cover is in the fully open position.

13. A container comprising a base portion having an open top, a cover to close the open top of said base portion, hinge means connecting said cover to said base portion so that said cover may be swung from a position closing the top of said base portion to an open position, complementary means carried by said base portion and carried by said cover to temporarily latch said cover to said base portion after said cover has been swung to the open position, first plate means extending outwardly from said base portion, and second plate means spaced from said first plate means and extending outwardly from said base portion, said first plate means having a portion of said complementary means on its side facing away from said second plate means.

14. A container according to claim 13 further comprising handle means between said first and second plate means.

15. A container according to claim 13 further comprising first arm means extending outwardly from said cover and adjacent said first plate means, and second arm means extending outwardly from said cover and adjacent said second plate means, said first arm means having a portion of said complementary means on its side facing said second arm means and facing the side of said first plate means having said portion of said complementary means.

16. A container according to claim 15 wherein said complementary means includes first barb means on said first plate means and second barb means on said first arm means.

17. A container according to claim 16 wherein said first and second barb means each include a camming surface, said camming surface of said second barb means riding over said camming surface of said first barb means as said cover is being swung to the open position.

18. A container according to claim 17 wherein said first and second barb means each includes a lock surface at the end of said camming surface, said lock surfaces engaging each other when said cover is in the fully open position.

19. A container comprising a base portion having an open top, a cover to close the open top of said base portion, hinge means connecting said cover to said base portion near the top of said base portion on one side thereof so that said cover may be swung from a position closing the top of said base portion to an open position, complementary means carried by said base portion and carried by said cover to temporarily latch said cover to said base portion after said cover has been swung to the open position, first plate means extending outwardly from said base portion on said one side thereof, first arm means extending outwardly from said cover adjacent to said first plate means, second plate means extending outwardly from said base portion and spaced from said first plate means, second arm means extending outwardly from said cover and spaced from said first arm means, handle means in the space between said first plate means and said first arm means and said second plate means and said second arm means, said first plate means and said first arm means having outer ends, and wheels mounted near the bottom of said base portion on said one side thereof, said hinge means including pin means attaching said outer end of said first plate means to said outer end of said first arm means so that said first arm means can rotate on said pin means with respect to said first plate means.

20. A container according to claim 19 wherein said second plate means and said second arm means have outer ends and said pin means also attaches said outer end of said second plate means to said outer end of said second arm means, said handle means having outer ends which are attached to said pin means.

21. A container according to claim 20 wherein said complementary means includes first lock barb means on said plate means and second lock barb means on said arm means, said first and second lock barb means engaging each other to temporarily latch said cover to said base portion.

22. A container according to claim 21 wherein said first and second barb means each include a camming surface, said camming surface of said second barb means riding over said camming surface of said first barb means as said cover is being swung to the open position.

23. A container according to claim 22 wherein said first and second barb means each includes a lock surface at the end of said camming surface, said lock surfaces engaging each other when said cover is in the fully open position.

* * * * *